United States Patent [19]

Dawson, Jr. et al.

[11] Patent Number: 4,880,397

[45] Date of Patent: Nov. 14, 1989

[54] FILTERED CABLE HARNESS CONNECTOR ASSEMBLY

[75] Inventors: Andrew J. Dawson, Jr.; John C. Farrar, both of Harrisburg; Douglas J. Pirc, Mechanicsburg; Atalee S. Taylor, Palmyra, all of Pa.

[73] Assignee: AMP Incorporated, Harrisburg, Pa.

[21] Appl. No.: 277,106

[22] Filed: Nov. 29, 1988

[51] Int. Cl.[4] ..... H01R 13/66

[52] U.S. Cl. ..... 439/620; 333/185

[58] Field of Search ..... 333/181-185; 439/620

[56] References Cited

U.S. PATENT DOCUMENTS

| | | | |
|---|---|---|---|
| 4,231,628 | 11/1980 | Hughes et al. . | |
| 4,269,467 | 5/1981 | Hughes . | |
| 4,337,574 | 7/1982 | Hughes et al. . | |
| 4,643,509 | 2/1987 | Hollyday et al. . | |
| 4,653,838 | 3/1987 | Ney et al. . | |
| 4,676,576 | 6/1987 | Feldberg et al. | 439/620 |
| 4,679,013 | 7/1987 | Farrar et al. | 439/620 |
| 4,769,908 | 9/1988 | Olsson . | |
| 4,772,225 | 9/1988 | Ulery . | |
| 4,772,761 | 9/1988 | Ibrahim et al. . | |
| 4,804,332 | 2/1989 | Pirc | 439/620 |
| 4,827,228 | 5/1989 | Blakely | 333/185 |

*Primary Examiner*—Gary F. Paumen

*Attorney, Agent, or Firm*—Katherine A. Nelson

[57] ABSTRACT

The present invention discloses a filtered cable harness connector assembly 10 including a multiterminal connector 12 having at least one row of terminals 18 therein terminated to conductors 28 of a cable 26, at least one filter subassembly 30 secured to the conductors 28 rearward of the multiterminal connector 12 and means covering the connector 12 and subassembly 30. The cable conductors are arranged in at least one planar array 29 and extend rearwardly from the connector 12 in a given lateral spacing. One filter subassembly 30 is associated with each at least one array of conductors. The subassembly 30 has plurality of contact members 32, a purality of filter members 58, means 50 housing the contact members 32 and filter members 58, and bus means 46. The plurality of contact members 32 have first and second contact portions 34, 40, the first contact portions 34 extending from a conductor proximate surface 52 of the housing means 50 and are appropriately spaced and adapted to become electrically connected with respective ones of the conductors 28 of the at least one array 29. The housing means 50 includes a plurality of filter receiving apertures 54 along a selected face thereof, and have the second contact portions 40 paired with third contact portions 44 and are exposed along respective bottom aperture surfaces. Filter member 58 are disposed in respective ones of the apertures and are electrically joined to respective pairs of said second and third contact portions 40, 44. Bus means extends from and commons third contact portions 44 and includes at least one ground engageable portion 48.

15 Claims, 3 Drawing Sheets

FILTERED CABLE HARNESS CONNECTOR ASSEMBLY

FIELD OF THE INVENTION

This invention relates to electrical connectors and more particularly to filtered electrical connectors and filtering devices for cable harnesses to provide protection against electromagnetic interference and radio frequency interference.

BACKGROUND OF THE INVENTION

Electrical circuitry often must be protected from disruptions caused by electromagnetic interference (EMI) and radio frequency interference (RFI) entering the system.

In addition to protecting electronic equipment against EMI/RFI energy, there is also a need to protect the equipment against power surges owing to electrostatic discharges (ESD) and electromagnetic pulse (EMP). The high voltage generated by ESD and EMP can damage voltage sensitive integrated circuits and the like.

Frequently today's electronic circuitry requires the use of high density, multiple contact electrical connectors. There are many applications in which it is desirable to provide a connector with a filtering capability, for example, to suppress EMI and RFI. In addition, there is often a need for a cost effective means of retrofitting existing electronic equipment to include filtering capability. To retain the convenience and flexibility of the connector, however, it is desirable that the filtering capability be incorporated into connectors in a manner that will permit full interchangeability between the connectors and their unfiltered counterparts. In particular, any filtered connector should in many instances retain substantially the same dimensions as the unfiltered version and should have the same contact arrangement so that either the filtered or the unfiltered version can be connected to an appropriate mating connector. Additionally it is sometimes desirable to filter only certain lines within a connector and to use the same basic connector in a number of applications, each requiring different selected lines to be filtered.

One means to protect against undesirable interference without altering the internal structure of a connector is by the use of shielding. The shielding may take several forms. For adequate protection, it is essential, however, that there be no break in continuity of the shielding.

Other means for shielding include the use of internal filtering arrangement that include the use of filter sleeves and planar filter members. Both of these methods generally require the additional space within the connector housing to accommodate the sleeves or other filtering devices. Furthermore, connectors of this type often include a number of labor intensive steps during the manufacture of the connectors. These connectors are not readily manufacturable by automatic equipment.

In many instances it is desirable to have an external filtering device that is an "add-on" device to provide filtering to an already existing non-filtered connector. This is particularly desirable in instances when the same basic connector may be used in a number of different applications, each requiring filtering of different lines in the connector. U.S. Pat. No. 4,804,332, owned by this assignee discloses a filtered electrical device adapted to be mounted externally to an electrical article such as an electrical connector and electrically engageable to circuit paths thereof. The device includes contact portions that are electrically engageable to corresponding contact sections of the electrical article. In some applications, it is desirable to have a means for filtering articles such as cable harness assemblies, for example, wherein the filtering device must be completely contained within the connectors used in the assembly. often the configuration of the connectors associated with such harnesses are of the type that is unsuitable for use with an externally mounted device. It is desirable, however, that an "add-on" filtering means be available for use with cable connectors.

SUMMARY OF THE INVENTION

It is an object of the present invention to provide electrical filtering means for filtering articles such as cable harness assemblies.

It is an object of the present invention to provide a filtered adaptor for cable assemblies and the like.

It is another article of the invention to provide a filtering device that can be added on to an existing unfiltered connector.

It is a further object of the invention to provide an external filtering device that lends itself to automated assembly procedures.

Furthermore, it is an object of the invention to provide a device for filtering connectors wherein the filtering device may be included only on selective circuit paths.

The present invention is directed to a filtered cable harness connector assembly, the assembly including a multiterminal connector having at least one row of terminals therein terminated to conductors of a cable, at least one filter subassembly secured to the conductors rearward of the multiterminal connector and means covering the connector and subassembly. The cable conductors are arranged in at least one planar array and extend rearwardly from the connector in a given lateral spacing. One filter subassembly is associated with each at least one array of conductors. The subassembly has plurality of contact members, a plurality of filter members, means housing the contact members and filter members, and bus means. The plurality of contact members have first and second contact portions, the first contact portions extending from a conductor proximate surface of the housing means and are appropriately spaced and adapted to become electrically connected with respective ones of the conductors of the at least one array. The housing means includes a plurality of filter receiving apertures along a selected face thereof, the second contact portions being exposed along respective bottom surfaces of respective said apertures. Third contact portions paired with second contact portions and spaced therefrom are exposed along respective bottom aperture surfaces. The plurality of filter members are disposed in respective ones of the apertures and are electrically joined to respective pairs of said second and third contact portions. The bus means extends from and commons the third contact portions and has at least one ground engageable portion exposed at least by the housing means. Each filter subassembly is securable within the cable harness connector assembly along each array of conductors with said first contact portions electrically connected with respective said conductors. The covering means is such that the at least one ground engageable bus portion is exposed to be engaged by grounding means.

In the preferred embodiment of the cable harness connector assembly, the connector includes two rows of terminals and the cable conductors form two planar arrays. A filter subassembly is terminated to each of the conductor arrays. The first contact portion is an insulation displacement contact (IDC). Grounding for the cable harness assembly is provided by a ground clip member which engages the bus portions of the two filter assemblies and extends outside the cover means and is engageable by further ground means.

The invention itself, together with further objects and its attendant advantages will be best understood by reference to the following detailed description, taken in conjunction with the accompanying drawings.

DETAILED DESCRIPTION OF THE DRAWINGS

Figure 1:
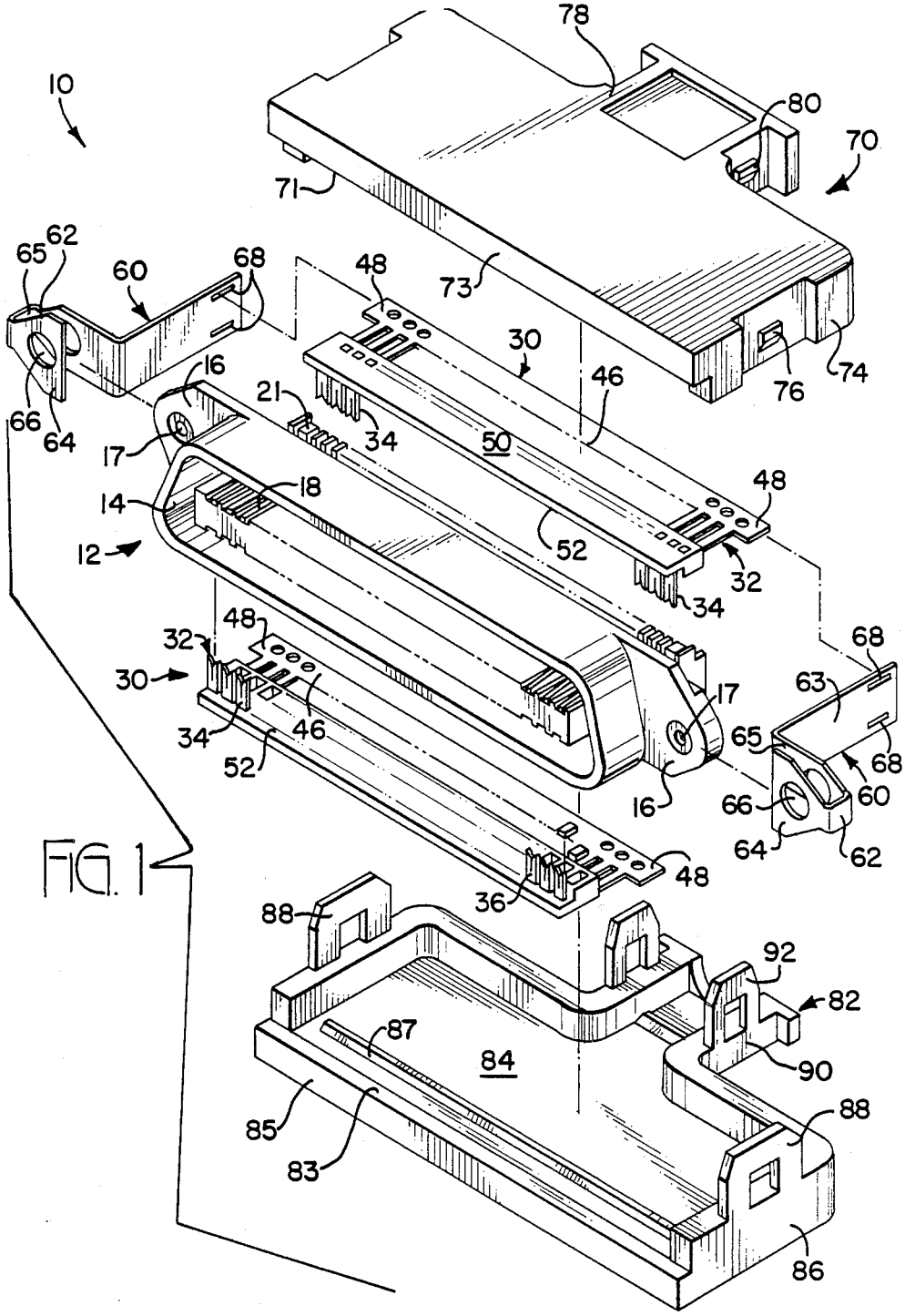
FIG. 1 is an exploded view of the electrical connector of the present invention.
Figure 2:
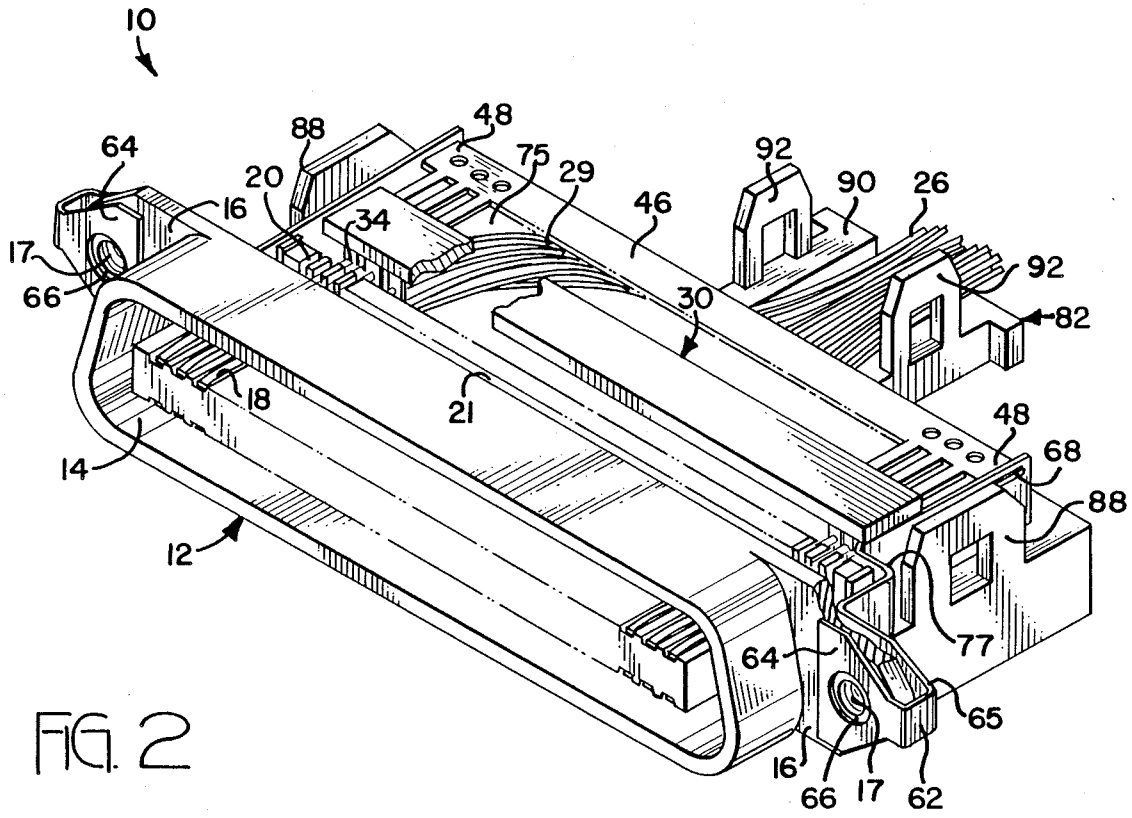
FIG. 2 is a perspective partially assembled view of the electrical connector assembly of FIG. 1 having one part of the housing removed.
Figure 4:
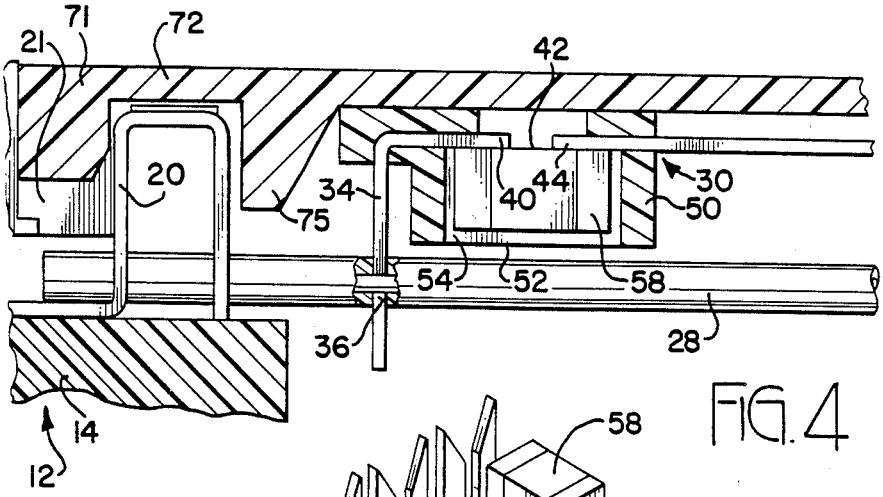
FIG. 4 is a fragmentary cross-sectional view of the assembled electrical connector of FIG. 1.

Referring now to FIGS. 1, 2, and 4, cable harness connector assembly 10 is comprised generally of a multiterminal electrical connector 12, filter member subassembly 30, ground clip member 60 and first and second cover members 70, 82 respectively. Assembly 10 is designed to be used with a cable comprised of cable 26 having a plurality of elongated conductor members 28. Connector assembly 10 is intended for use in a cable harness assembly having connector 12 on one end of the cable and another connector terminated to the other end of the cable (not shown). Cable 26 may be a discrete wire cable or a ribbon cable. Connector 12 preferable has two rows of terminals 18. Cable 26 is shown as a discrete wire cable having a plurality of conductors 28 equal in number to that of terminal members 18. In the preferred embodiment, conductors 28 extend rearwardly from terminals 18 in two planar arrays 29 having a given lateral spacing. Conductors 28 are gathered together and exit as cable member 26 at the rear of the cover members 70, 82. When connector 12 is used with a ribbon cable, a separate ribbon member is used for each row of terminals in connector 12. The cover members are adapt at the rearward end to allow for the passage of ribbon cable rather than an essentially round cable of discrete wires.

Electrical connector 12 is comprised of a dielectric housing member 14 having at least one flange portion 16 extending outwardly therefrom and a plurality of terminals 18 disposed therein. In the preferred embodiment electrical terminal members 18 have insulation displacement contact sections 20 which are terminated to respective conductors 28 of cable 26 as best seen in FIG. 4.

Figure 3:
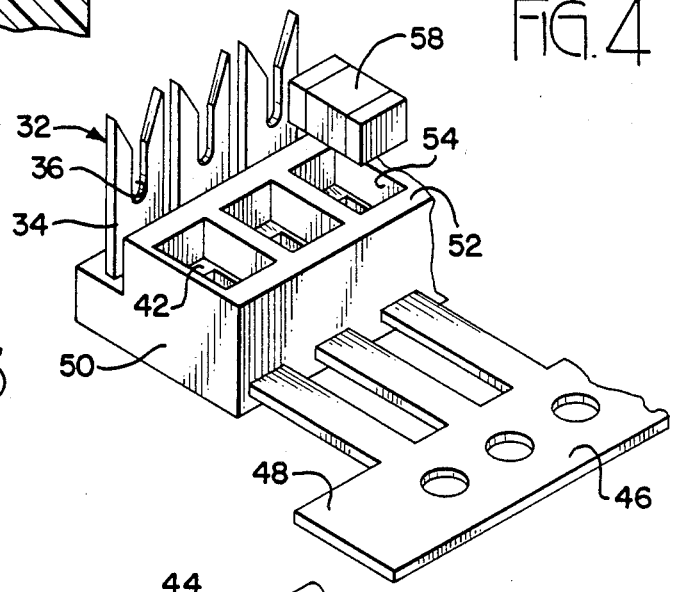
FIG. 3 is a fragmentary perspective view of the filtering component of the present invention.

Filter member subassembly 30 as shown in FIGS. 1–4 is designed to be used in cable harness connector assembly 10 to provide filtering for selected conductors 28 of the cable 26. Assembly 30 is comprised of a plurality of contact members 32, dielectric housing means 50 and filter members 58. Contact members 32 have first and second contact portions 34 and 40 respectively. First contact portions 34 are engageable with corresponding conductors 28 of an electrical cable 26. First contact portions 34 extend from a conductor proximate surface of housing means 50 and are appropriately spaced and adapted to be electrically connected with respective ones of the conductors of each array 29. First contact portions 34 include connecting means 36 for electrically connecting first contact portion 34 to corresponding conductors and are preferably having insulation displacement slots 36 therein. As best seen in FIGS. 3 and 4, dielectric housing means 50 includes a plurality of filter receiving apertures 54 along a selected face 52 thereof. Second contact portions 40 are exposed along a bottom surface of respective apertures 54. Third contact portions 44 are paired with second contact portions 40 and are spaced therefrom at 42. Third contact portions 44 are also exposed along the bottom surface of respective filter receiving apertures 54. A plurality of filter members 58 are disposed in respective filter receiving apertures 54 of housing means 50 and are electrically joined to respective pairs of second and third contact portions 40, 44. Filter members 58 are surface mounted components such as chip capacitors, resistors, uni- or bi-polar diodes or the like. Bus means 46 as shown in FIG. 4 extends outwardly from and commons third contact portions 44. Bus means 46 includes at least one ground engageable portion 48 which is exposed at least by housing means 50. In the preferred embodiment bus means 46 extends from housing means 50 and includes two ground engageable portions 48.

In the preferred embodiment ground means 60 is a grounding clip having first forward portion 62 and rearwardly extending second portion 63. Referring now to FIGS. 1 and 2 first portion 62 is adapted to be mounted over flange 16 of connector 12. Second portion 63 includes slots 68 therein for receiving ends 48 of bus means 46 of the filter member subassembly 30. First portion 62 includes opposed tab members 64 for defining a slot 65 therebetween for receiving the flange 16. Tab members 64 include aperture 66 which are adapted to be aligned with aperture 17 of flange 16 for mounting to a back plane, chassis, or the like or other grounding means for cable harness connector assembly 10.

First and second interlocking cover members 70, 82 respectively are dielectric members and together define a housing cavity 75 for receiving therein conductor arrays 29, and respective filter member subassemblies 30 mounted thereto. Cover members 70, 82 are securable to housing member 14 by means of ledges 71, 83 on respective front walls 73, 85 of covers 72, 80, ledges 71, 83 being receivable in cooperating slots 21 on opposed sides of connector 12 as best seen in FIG. 4. First cover member 70 further includes first and second portions 72, 78 and sides 74. Latching means 76, 80 extending outwardly from sides 74. Cover member 82 is comprised of first portion 84, second portion 90 and sides 86. Sides 86 having latching means 86, 92 thereon which cooperate with first cover latching means 76, 80, to secure the cover members 70, 82 together around the cavity 73. In the assembled cover unit internal ribs 75, 87 as seen in FIGS. 4 and 1 respectively rest against conductor arrays 29 proximate the terminated end of conductors 28. The rearward second portions 78, 90 of the latched covers provide a cable strain relief for the cable harness.

In making the filtered cable harness connector assembly of the present invention, conductors 28 of cable 26 are terminated to respective terminals 18 of electrical connector subassembly 12 as known in the art. Generally the terminals are preloaded into a connector housing in two rows such that essentially one-half of the conductors will be terminated to one row of terminals and the other half will be terminated to the second row of terminals, for example in a 25 position connector, the terminals will be in rows of 12 and 13 each. The conductors of the cable will be divided in a similar manner and usually mass terminated to the terminals in respective rows. The portions of the conductors proximate the terminated ends are in a planar array and extend rearwardly from the terminals in a given lateral spacing. A filter subassembly having a plurality of first contact portions arranged in a similar lateral spacing is aligned with the corresponding conductors such that the IDC slots engage the wire members of the conductors as the subassembly is pushed against the array of conductors. The configuration of the subassembly 30 permits all of the first contact portions 34 to be engaged with the conductors via the insulation displacement slot 36 in one operation.

In a typical two row connector, a filter subassembly 30 will be attached in a similar manner to the other array of conductors in the connector. After the subassemblies 30 have been added, the ground clip member 60 is engaged to the ends 48 of bus means 46 and s shown in FIG. 2 extends toward the connector and engages a flange portion thereof. The cover members 70, 82 are then latched in place over the assemblies to encase the ends of the terminals the terminated conductors, the array of conductors and the filter assemblies attached thereto. The outer face surfaces of subassemblies 30 lie against the inside surfaces of cover members 70, 82. As can be seen from FIG. 2, grounding clip 60 extends in an opening 77 in the housing and into cavity 75.

It is to be understood that when the connector is used with ribbon cable, one or more ribbon cable members are used to terminate to corresponding rows in the connector. It is further to be understood that the connector shown in the Figures is representative of the types of connectors that may be filtered in the disclosed manner and attached to a cable harnesses.

The preferred method of making electrical filtering device 100 is disclosed in U.S. Pat. No. 4,804,332 which is incorporated herein by reference. The method is summarized as follows. Electrical component 30 is preferably made in continuous form by stamping and forming a plurality of lead frames in suitable flat stock metal such as copper, phosbronze, or the like, as known in the art. The strip of frames has a plurality of essentially parallel crossbar members which later become first, second and third contact member sections 34, 40 and 44 attached to a carrier strip which later becomes bus bar means 46. Housing members 50 are insert molded around portions of the crossbar members, the housings 50 including a plurality of apertures 54 each located over respective crossbar member. A portion of each crossbar member is removed to form associated spaced apart second and third contact member section 40, 44. Filter members 58 are mounted and secured in electrical and mechanical engagement with second and third contact members 40, 44, preferably by solder. Filtered subassemblies 30 can completely form on the strip while remaining attached to a carrier strip. The strip of filter subassemblies can be rolled onto a reel (not shown) until subassembly 30 is ready to be used in a connector. Individual subassemblies 30 can be severed from the strip as needed. The process for making subassembly 30 lends itself to automation since a metal strip may be stamped and formed, rolled on a reel (not shown), and later formed into subassemblies 30.

Figure 5:
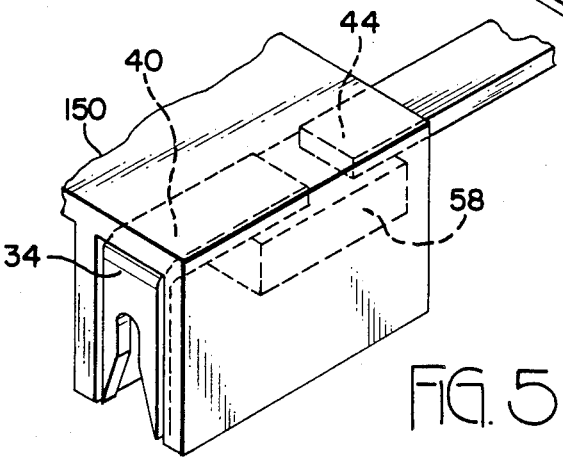
FIG. 5 is an alternative embodiment of the filtering component.

FIG. 5 illustrates an alternative embodiment 130 of the electrical filtering device in which housing member 150 completely encases first contact section 34 thereby providing a more rigid structure therefor.

The filter assembly of the present invention provides a means whereby cost effective chip carrier technology can be used for rapid, mass IDC engagement of electrical components to ribbon or discrete wire cable assemblies. The components are mounted in parallel to the terminal and are mounted onto the wire, rather than the connector thereby not affecting the outer or mating face of the electrical connector subassembly. Both active and passive components may be mounted in parallel on the connector. In crimping the IDC contact it can be pressed with a header or a comb wire straight down to align and orient the wire and IDC slots. Preferably, the filtered cable harness assembly is mounted to ground on a chassis or a I/O port to ground.

It is to be understood that the electrical connector of the present invention is a representative sample only. It is to be further understood that form and shape and types of connectors with which this device may be used are numerous. By filtering electrical connectors used in cable harness assemblies with an filtering assemble, it is possible to selectively filter lines by omitting filter members from the various apertures. This allows the same basic connector to be filtered readily, in a variety of configurations and in a cost effective manner. The filtering device uses small capacitors, transient suppression diodes, resistors or other electrical components that are designed to be in parallel with the circuit, between terminal and ground. The components used for any one connector need not be identical and selected frequencies may be controlled by placing filter devices of varying capabilities at selected locations. The filter component of the present invention is designed for filtering in the lower frequency ranges, preferably not to exceed 500 megahertz.

It is thought that the filtered connector of the present invention and many of its attendant advantages will be understood from the foregoing description. It will be apparent that various changes may be made in the form, construction and arrangement of the parts thereof without departing from the spirit or scope of the invention or sacrificing all its material advantages. The form herein described is merely a preferred or exemplary embodiment thereof.

What is claimed is:

1. A filtered cable harness connector assembly, the assembly including a multiterminal connector having at least one row of terminals therein, at least one planar array of conductors terminated to respective ones of the terminals and extending rearwardly from the connector in a given lateral spacing, the assembly further comprising:

a filter subassembly associated with each said at least one array of conductors and each assembly having a plurality of contact members, a plurality of filter members, means housing said contact members and said filter members, and bus means;

said plurality of contact members having first and second contact portions, said first contact portions extending from a conductor proximate surface of said housing means and being appropriately spaced and adapted to become electrically connected with respective ones of said conductors of said at least one array;

said housing means including a plurality of filter receiving apertures along a selected face thereof, said second contact portions being exposed along respective bottom surfaces of respective said apertures;

third contact portions paired with said second contact portions and spaced therefrom, said third contact portions being exposed along respective said aperture bottom surfaces;

said plurality of filter members disposed in respective said apertures and electrically joined to respective pairs of said second and third contact portions;

said bus means extending from and commoning said third contact portions and having at least one ground engageable portion exposed by said housing means;

each said filter subassembly being securable within said cable harness connector assembly along each said array of conductors rearwardly of said connector with said first contact portions electrically connectable with respective said conductors; and means covering said connector, said at least one array of conductors and said at least one said filter assembly such that said at least one ground engageable bus portion is exposed to be engaged by grounding means.

2. The filtered cable harness assembly of claim 1 wherein said cover means includes a dielectric connector housing member in which said terminals are disposed and first and second dielectric cover members which together define a housing cavity for receiving therein said at least one array of conductors having a respective one of said at least one filter subassembly connected thereto, said cover members being securable to said connector housing member.

3. The filtered cable harness assembly of claim 1 wherein said means for electrically connecting said ground engageable portion of said bus means includes at least one ground clip member having first and second portions, said second portion having at least one aperture extending therethrough for receiving said portion of said bus means, said first ground clip portion extending outwardly of said cover means for electrical engagement to ground.

4. The filtered cable harness assembly of claim 3 wherein said connector housing includes at least one flange portion extending therefrom and said first portion of said at least one ground clip member includes a flange engaging means for mounting to said connector housing flange portion.

5. The filtered cable harness assembly of claim 4 wherein said bus means includes two ground engageable portions, said connector housing member includes two flange portions and said means for grounding includes two ground clip members.

6. The filtered cable harness assembly of claim 1 wherein said multiterminal connector has two rows of said terminals therein and two rows of said planar arrays of conductors terminated to respective ones of the terminals and extending rearwardly from the connector in a given lateral spacing, and two said filter subassemblies, one subassembly being electrically connected to each array of conductors.

7. The filtered cable harness assembly of claim 6 wherein said means for electrically connecting said ground engageable portion of said bus means of respective ones of said two filter subassemblies is at least one ground clip member having first and second portions, said second portion having two apertures extending therethrough for receiving respective ones of said portion of said bus means, said first ground clip portion extending outwardly of said cover means for electrical engagement to ground.

8. The filter adaptor for a cable harness connector as described in claim 1 wherein said first contact members of two filter member subassemblies are electrically connected to respective ones of said conductors of said cable harness, said subassemblies being connected on opposed sides of said cable with each said assembly electrically connected to said grounding means.

9. The filtered cable harness assembly of claim 1 wherein said cable is a discrete wire cable.

10. A filtered cable harness connector assembly, the assembly including a multiterminal connector having two rows of terminals therein, two planar arrays of conductors terminated to respective ones of the terminals and extending rearwardly from the connector in a given lateral spacing, the assembly further comprising:

two filter subassemblies, one associated with each of said two arrays of conductors and each having a plurality of contact members, a plurality of filter members, means housing said contact members and said filter members, and bus means;

said plurality of contact members each having first and second contact portions, said first contact portions extending from a conductor proximate surface of said housing means and being appropriately spaced and adapted to become electrically connected with respective ones of said conductors of one said array;

each said housing means including a plurality of filter receiving apertures along a selected face thereof, said second contact portions being exposed along respective bottom surfaces of respective said apertures;

third contact portions paired with said second contact portions and spaced therefrom, said third contact portions being exposed along respective said aperture bottom surfaces;

said plurality of filter members being disposed in respective said apertures and electrically joined to respective pairs of said second and third contact portions;

each said bus means extending from and commoning respective said third contact portions and having at least one ground engageable portion exposed by said housing means;

each said filter subassembly being securable within said cable harness connector assembly along a respective said array of conductors rearwardly of said connector with said first contact portions electrically connectable with respective said conductors; and means covering said connector, said arrays of conductors and said filter assemblies such that said ground engageable bus portions are exposed to be engaged by grounding means.

11. The filtered cable harness assembly of claim 10 wherein said cover means includes a dielectric connector housing member in which said terminals are disposed and first and second dielectric cover members which together define a housing cavity for receiving therein said two arrays of conductors having a respective one of said two filter subassemblies connected thereto, said cover members being securable to said connector housing member.

12. The filtered cable harness assembly of claim 10 wherein said means for electrically connecting said ground engageable portion of said bus means of respective ones of said subassemblies is at least one ground clip member having first and second portions, said second portion having two apertures extending therethrough for receiving respective ones of said portions of said bus means, said first ground clip portion extending outwardly of said cover means for electrical engagement to ground.

13. The filtered cable harness assembly of claim 12 wherein said connector housing includes at least one flange portion extending therefrom and said first portion of said at least one ground clip member includes a flange engaging means for mounting to said connector housing flange portion.

14. The filtered cable harness assembly of claim 13 wherein said bus means includes two said ground engageable portions, said connector housing member includes two said flange portions and said means for grounding includes two said ground clip members.

15. The filtered cable harness assembly of claim 10 wherein said cable is a discrete wire cable.

* * * * *

UNITED STATES PATENT OFFICE

CERTIFICATE OF CORRECTION

Patent No. 4,880,397 Dated November 14, 1989

Inventor(s) Andrew J. Dawson Jr. et al.

It is certified that error appears in the above-identified patent and that said Letters Patent is hereby corrected as shown below:

In the Claims:

Claim 1, Column 6, Line 62 - the word "assembly" should be --subassembly--

Signed and Sealed this

Third Day of December, 1991

*Attest:*

HARRY F. MANBECK, JR.

*Attesting Officer*

*Commissioner of Patents and Trademarks*